US011512500B1

(12) United States Patent
Lawrence

(10) Patent No.: US 11,512,500 B1
(45) Date of Patent: Nov. 29, 2022

(54) MODIFIED TILT LATCH BOLT

(71) Applicant: Barry G. Lawrence, Thomasville, NC (US)

(72) Inventor: Barry G. Lawrence, Thomasville, NC (US)

( * ) Notice: Subject to any disclaimer, the term of this patent is extended or adjusted under 35 U.S.C. 154(b) by 290 days.

(21) Appl. No.: 16/541,666

(22) Filed: Aug. 15, 2019

(51) Int. Cl.
*E05B 65/08* (2006.01)
*E05B 17/00* (2006.01)

(52) U.S. Cl.
CPC ..... *E05B 65/0876* (2013.01); *E05B 17/0054* (2013.01); *E05Y 2900/148* (2013.01)

(58) Field of Classification Search
CPC ..... E05B 65/0876; E05B 17/0054; E05B 65/087; E05Y 2900/148; Y10S 292/20; Y10S 292/47
USPC ..... 292/1, 137, 163, 175, 138; 49/449
See application file for complete search history.

(56) References Cited

U.S. PATENT DOCUMENTS 389,217 A * 9/1888 Glenn ..... E05F 11/00 292/342
5,669,639 A * 9/1997 Lawrence ..... E05C 1/10 292/175
6,874,826 B1 * 4/2005 Polowinczak ..... E05C 1/10 292/163
7,520,541 B1 4/2009 Lawrence
7,658,035 B1 2/2010 Lawrence
8,220,846 B2 * 7/2012 Liang ..... E05D 15/22 292/163
9,316,043 B1 4/2016 Lawrence
2008/0302017 A1 * 12/2008 Phillips ..... E05C 1/06 49/161

* cited by examiner

*Primary Examiner* — Christine M Mills
*Assistant Examiner* — Yahya Sidky
(74) *Attorney, Agent, or Firm* — Tuggle Duggins P.A.; Blake P. Hurt

(57) ABSTRACT

An improved tilt latch bolt for a double-hung window with a groove or channel formed in either the biased or planar portion of the bolt nose for engaging a portion of the window frame when the window is under duress is disclosed herein. The grooves and channels define a depth of at least five thousandths of an inch (0.127 cm). The deformable cantilever, by virtue of being formed above, and extending over the channel, is resilient such that were a portion of the window jamb to clear the width of channel, the deformable cantilever provides a small degree of tolerance to capture the wayward window jamb before it inadvertently rotates out of the sash, for example in inclement weather conditions.

5 Claims, 4 Drawing Sheets

MODIFIED TILT LATCH BOLT

FIELD OF THE INVENTION

The invention herein pertains to latch hardware and particularly pertains to a modified latch bolt for a tilt latch that preferably includes a resilient cantilever that uncovers a channel to catch a portion of the window frame therein when the window is under duress.

DESCRIPTION OF THE PRIOR ART AND OBJECTIVES OF THE INVENTION

Despite numerous innovations in material science and the mechanics that affect them, the business end of a tilt latch bolt has remained unchanged for quite some time. Typically defining a rectangular or wedge geometry, this distal bolt surface positioned at an opposing end relative to the remainder of the latch components is charged with frictionally engaging a portion of the window sash generally referred to as the window stile or jamb to prevent modern tillable windows from rotating out of the window frame unless desirable, for example for cleaning. This rotatable feature is useful at certain times, but it can be a liability and potential hazard to others. For example, the same functional feature that permits the usually vertically oriented window sash to pivot horizontally may also permit the window to disassociate from its jamb in inclement weather. It is considered a well-known phenomenon that the structural components of a window frame, but most notably the vertical stiles, can flex dramatically in high winds, particularly with windows that are formed from polymeric materials such as vinyl. While windows generally, and tilt latches and their respective bolts particularly, are engineered with tolerance for some level of displacement, these tolerances are not infinite and when the jamb surfaces moves sufficiently away from the bolt, little or nothing remains to hold the window in a vertical orientation.

Thus, in view of the problems and disadvantages associated with prior art devices, the present invention was conceived and one of its objectives is to provide a tilt latch bolt that is configured to engage a window jamb in the case of inclement weather.

It is another objective of the present invention to provide a tilt latch bolt that is simple to manufacture and simple to install.

It is still another objective of the present invention to provide a tilt latch bolt that defines a resilient cantilever on the bolt nose.

It is yet another objective of the present invention to provide a tilt latch bolt that defines a resilient cantilever on the bolt nose that is sized and shaped to extend when pressure from the window jamb is released.

It is a further objective of the present invention to provide a tilt latch bolt that defines a resilient cantilever on the bolt nose that is covered, for example by a piece of flashing, when pressure from the window jamb otherwise prevents the cantilever from extending.

It is still a further objective of the present invention to provide a tilt latch bolt that defines a resilient cantilever on the bolt nose that is sized and shaped to extend when pressure from the window jamb is released, revealing a channel sized and shaped to accept a portion of the window jamb therein.

It is yet a further objective of the present invention to provide a polymeric window latch bolt that is resistance to abrasion and impact damage but that defines sufficient resiliency to incorporate a cantilever as described above.

Various other objectives and advantages of the present invention will become apparent to those skilled in the art as a more detailed description is set forth below.

SUMMARY OF THE INVENTION

The aforesaid and other objectives are realized by providing an improved tilt latch bolt, of the type typically associated with a tilt latch affixed to a double-hung window sash, with a resilient cantilever that uncovers a channel sized and shaped to engage a portion of the window frame when the window is under duress. The cantilever is formed on the exterior portion of a terminal end of the bolt opposite the latch (sometimes referred to as the "nose"), on the surface that frictionally engages the window jamb when the bolt is extended (the straight, as opposed to the biased, face). In the manufacture of the bolt, the cantilever is designed with a bias to extend outwardly from the bolt body, and when the bias causes extension of the cantilever from the bolt body, the separation reveals a channel defined therein. This channel is sized and shaped to receive a portion of the window jamb therein, resisting inadvertent disassociation from the window jamb, for example during inclement weather when the entire window frame may spatially displace.

DETAILED DESCRIPTION OF THE PREFERRED EMBODIMENT AND OPERATION OF THE INVENTION

Figure 1:
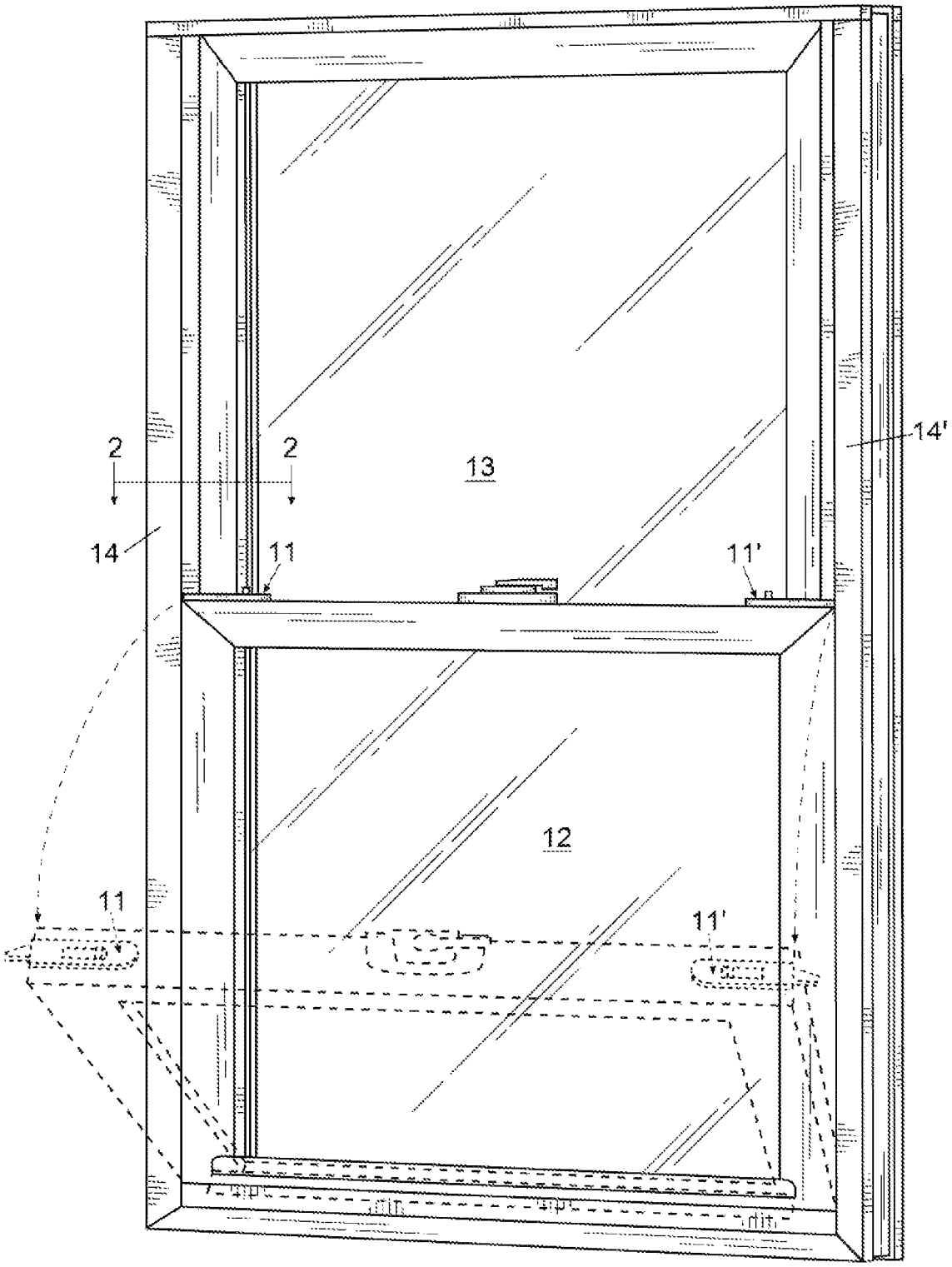
FIG. 1 shows a double-hung window assembly with a tilt latch including a modified tilt latch bolt.
Figure 2:
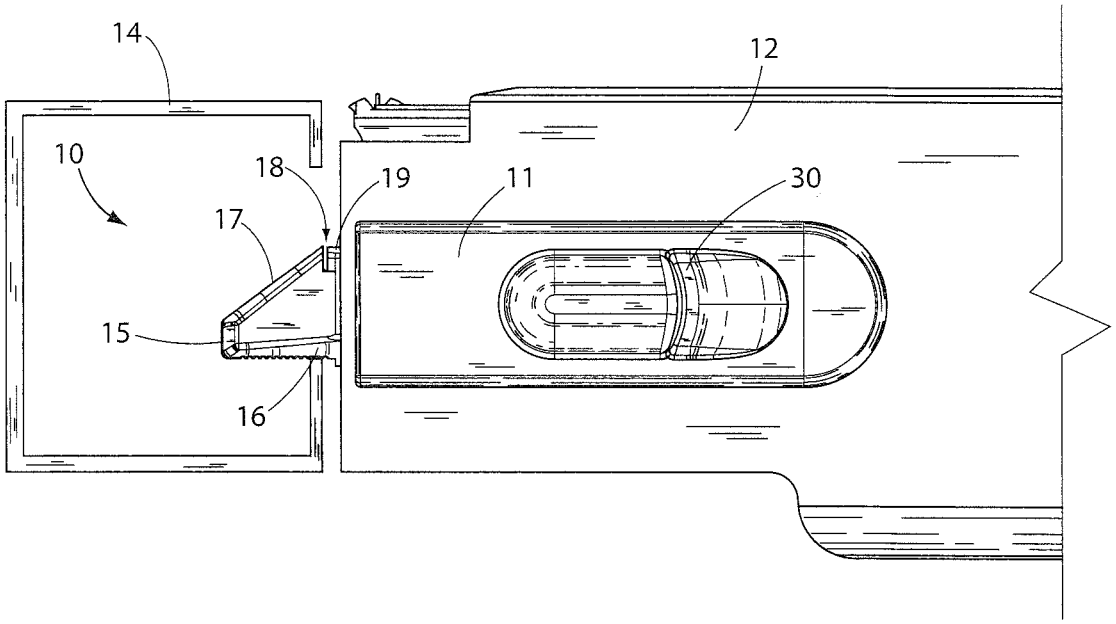
FIG. 2 pictures a top plan view of the modified tilt latch bolt engaged with a section of the window jamb as seen along lines 2-2 of FIG. 1.
Figure 3:
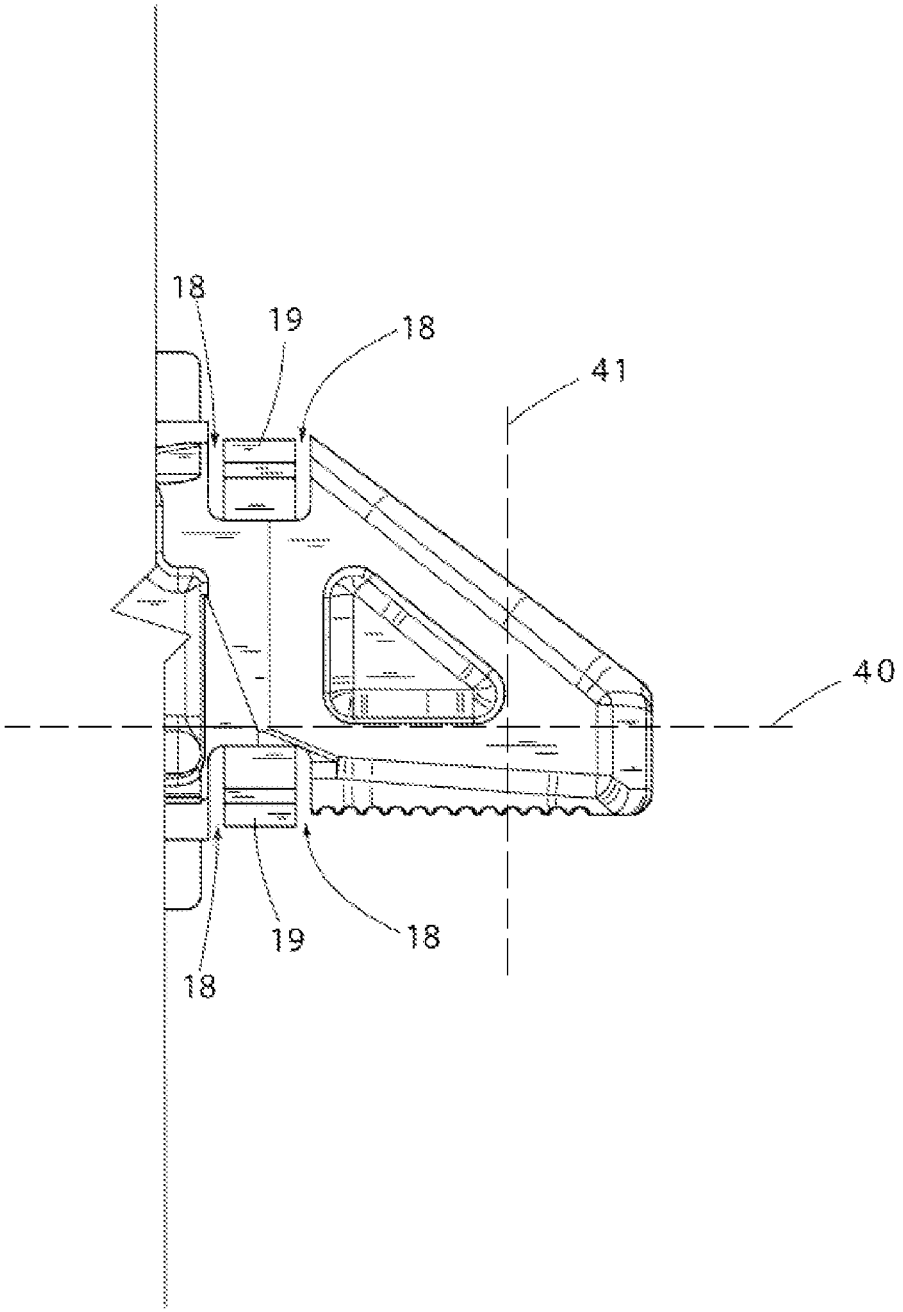
FIG. 3 depicts a portion of the modified tilt latch bolt without the window jamb of FIG. 2.

For a better understanding of the invention and its operation, turning now to the drawings, FIGS. 1-3 illustrate the preferred embodiment of modified tilt latch bolt 10 associated with tilt latches 11, 11' disposed on lower sash 12 of a conventional double-hung window sash together with upper sash 13. Referring to FIG. 1, it would be understood that upper and lower sashes 12, 13 move vertically within window frame jambs 14 and 14'. As known in the art, lower sash 12 may also pivot to tilt inwardly for cleaning and so forth (as shown in dashed lines). When the lower sash 12 is in the closed position, as depicted in the drawing, tilt latches 11 and 11' engage respective portions of window jambs 14 and 14'. Specifically, the distal end of the bolt (relative to the latch with which the bolt is associated) frictionally engages with the side walls of the window frame jambs. See for example, U.S. Pat. Nos. 7,520,541 and 7,658,035 each for a Tilt Latch, and U.S. Pat. No. 9,316,043 for a Window Frame and Method, owned by the inventor of the subject application, the entire disclosures of which are hereby incorporated by reference.

As would be understood, the bolt is an elongated member that generally defines a cylindrical or polygonal cross-sectional shape. Depicted more clearly in FIGS. 2 and 3, modified tilt latch bolt 10 preferably defines a rectangular cross-section consistent along the majority of its longitudinal length. Modified tilt latch bolt 10 is mechanically affixed at its proximal end (relative to the latch with which is it associated) with a button, level, arm, or other member 30 that may be engaged by a user as is known in the art for releasing tilt latch bolt 10 from jamb 14. At the opposing end, the majority of tilt latch bolts define an angled, beveled, or otherwise biased section or nose, often in the shape of a wedge, to facilitate the easy entry into the stored or closed position after the window has been rotated out of the jamb, for example for cleaning. It is this portion of the bolt that is responsible for maintaining the window within jambs 14 and 14' when not otherwise pivoted horizontally. However, as noted above, it is known that one or more structural component(s) of a window frame generally, but most notably the vertical stiles that serve to define said jambs 14 and 14', can flex dramatically in high winds, particularly with windows that are formed from polymeric materials such as vinyl. While windows generally, and tilt latches and their respective bolts particularly, are engineered with tolerance for some level of displacement, these tolerances are not infinite and when the jamb surfaces moves sufficiently away from the bolt, little or nothing remains to hold the window in a vertical orientation.

Therefore, preferred tilt latch bolt 10 defines additional features that aid in the frictional attachment of the bolt nose with the associated window jamb. The tilt latch bolt 10 defines a longitudinal axis 40 and a lateral axis 41, and defines bolt end 15 with a planar surface 16 and a biased surface 17. In the preferred embodiment, tilt latch bolt 10 is oriented such that biased surface 17 is facing the exterior of the window, so that biased surface 17 is the first portion of the bolt to contact the window jamb when the window is being returned to the vertical position. The tilt latch bolt 10 ideally includes a deformable cantilever 19. In one embodiment, a portion of planar surface 16 defines one or more grooves 18 therein, said deformable cantilever 19 is disposed within one of the one or more grooves 18 and extends along the lateral axis 41. In a separate embodiment, a portion of biased surface 17 defines one or more grooves 18 therein, said deformable cantilever 19 is disposed within one of the one or more grooves 18 and extends along the lateral axis 41. In a further embodiment as shown in FIG. 3, a portion of planar surface 16 and biased surface 17 each define one or more grooves 18 therein, wherein a deformable cantilever 19 is disposed within one of the one or more grooves 18 of a portion of a planar surface 16 and another deformable cantilever 19 is disposed within one of the one or more grooves 18 of a portion of the biased surface 17, both cantilevers 19 extending along the lateral axis 41. It is desirable that the two deformable cantilevers 19 are positioned opposite one another relative to the longitudinal axis 40. In any embodiment including a deformable cantilever 19, said deformable cantilever 19 may be positioned at a valley of one of the one or more grooves 18. Regardless of the embodiment, cantilevers 19 and grooves 18 are more than just ribs to increase friction on the surface of the window jamb. Rather, grooves 18 are sized and shaped to receive a portion of the jamb side wall therein. In one embodiment these grooves define a depth of at least five thousandths of an inch (0.127 cm). Because of this unique sizing and geometry, preferred tilt latch bolt 10 can better maintain the window sash in its vertical position, even when experiencing significant positive or negative pressure distortion.

Figure 4:
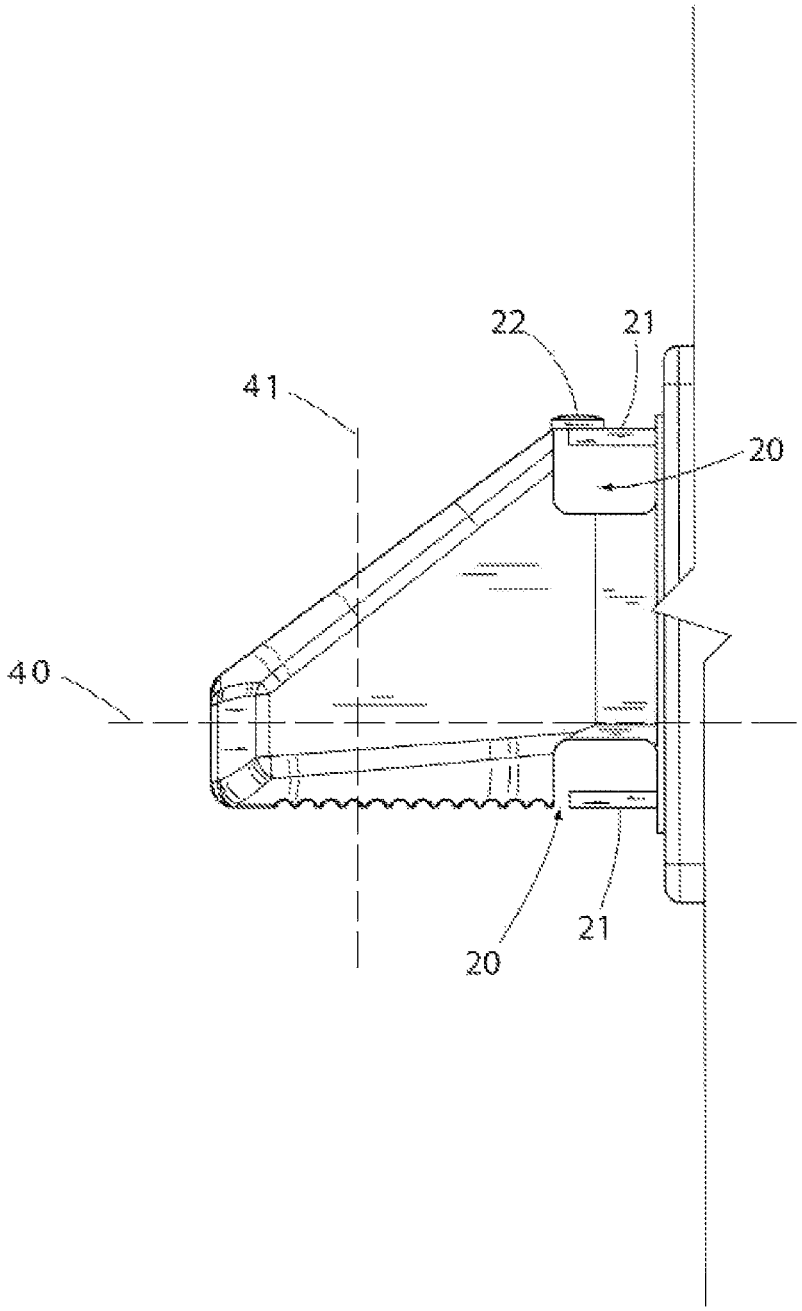
FIG. 4 demonstrates a portion of an alternate embodiment of the modified tilt latch bolt of FIG. 3.

In an alternate embodiment as shown in FIG. 4, a portion of planar surface 16 defines one or more channels 20 therein, said tilt latch bolt 10 preferably includes a deformable cantilever 21 that extends along the longitudinal axis 40 and is disposed within one of the one or more channels 20 of the planar surface 16. In a different embodiment, a portion of biased surface 17 defines one or more channels 20 therein, wherein the tilt latch bolt 10 includes a deformable cantilever 21 that extends along the longitudinal axis 40 and is disposed within one of the one or more channels 20 of the biased surface 17. In a further embodiment, a portion of planar surface 16 and biased surface 17 each define one or more channels 20 therein, wherein the tilt latch bolt 10 includes a deformable cantilever 21 that extends along longitudinal axis 40 and is disposed within one of the one or more channels 20 of planar surface 16 and a deformable cantilever 21 that extends along longitudinal axis 40 and is disposed within one of the one or more channels 20 of biased surface 17. It is desirable that the two deformable cantilevers 19 are positioned opposite one another relative to the longitudinal axis 40. In any embodiments with a cantilever 21, the cantilever 21 may be positioned proximate to an opening of one of the one or more channels 20. Similar to grooves 18, channels 20 are sized and shaped sufficiently to receive at least a portion of jamb wall therein, a portion that can better maintain the window sash in its vertical position compared to anything in the prior art, even when experiencing significant positive or negative pressure distortion. Additionally, or in the alternative, cantilever 21 may be positioned above an opening of a channel 20, and by virtue of being formed above channel 20 or proximate to an opening of a channel 20: deformable cantilever 21 is resilient such that were a portion of the window jamb to clear the width of channel 20, deformable cantilever 21 gives a small degree of tolerance to capture the wayward window jamb before it inadvertently rotates out of the sash, for example in inclement weather conditions.

In a further embodiment, it may be desirable to reinforce a section of tilt latch bolt 10 proximate channel 20, for example to provide additional structural integrity from impact when the opening of channel 20 is not needed for more conventional operation of the bolt. In this embodiment, a slight cover or shim 22 (considered herein as a structural portion of material that covers the opening of channel 20, but breaks away when it comes in contact with the window jamb side wall) extends over the opening of channel 20. In the manufacture of the bolt 10, the deformable cantilever 21 is engineered with a bias to extend outwardly from the bolt body, and when the bias causes extension of deformable cantilever 21 from the bolt body, specifically when deformable cantilever 21 is released from shim 22, the separation reveals channel 20 defined therein.

The illustrations and examples provided herein are for explanatory purposes and are not intended to limit the scope of the appended claims.

I claim:

1. A tilt latch bolt defining a longitudinal axis and a lateral axis, the tilt latch bolt including a planar surface and a biased surface, the planar surface and the biased surface each defining a channel; said tilt latch bolt including two cantilevers, one cantilever disposed within the channel of the biased surface and the other cantilever disposed within the channel of the planar surface, said two cantilevers positioned opposite to one another relative to the longitudinal axis of the tilt latch bolt, the channel of the biased surface and channel of the planar surface are, sized and shaped to receive a portion of a window jamb therein, said two cantilevers extend from a bolt end in a direction parallel to the longitudinal axis.

2. The tilt latch bolt of claim 1, wherein the channel of the planar surface defines a depth of at least five thousandths of an inch (0.127 cm).

3. The tilt latch bolt of claim 1, wherein the channel of the biased surface defines a depth of at least five thousandths of an inch (0.127 cm).

4. A tilt latch bolt defining a longitudinal axis and a lateral axis, the tilt latch bolt including a planar surface and a biased surface, the biased surface forming a cantilever and defining one or more channels therein, the cantilever extending parallel to the lateral axis about the tilt latch bolt longitudinal axis and above the one or more channels, the one or more channels of the biased surface sized and shaped to receive a portion of a window jamb therein, and the one or more channels defining a depth of at least five thousandths of an inch (0.127 cm).

5. A tilt latch bolt defining a longitudinal major and a lateral axis, the tilt latch bolt including a planar surface and a biased surface, the planar surface forming a cantilever and defining one or more channels therein, the cantilever extending parallel to the lateral axis about the tilt latch bolt longitudinal axis and above the one or more channels, the one or more channels of the planar surface sized and shaped to receive a portion of a window jamb therein, and the one or more channels defining a depth of at least five thousandths of an inch (0.127 cm).

* * * * *